US009538795B2

(12) United States Patent
Cobb

(10) Patent No.: US 9,538,795 B2
(45) Date of Patent: Jan. 10, 2017

(54) HANDS-FREE PUMPING GARMENT

(71) Applicant: Calisha Cobb, Hayward, CA (US)

(72) Inventor: Calisha Cobb, Hayward, CA (US)

( * ) Notice: Subject to any disclaimer, the term of this patent is extended or adjusted under 35 U.S.C. 154(b) by 164 days.

(21) Appl. No.: 14/091,446

(22) Filed: Nov. 27, 2013

(65) Prior Publication Data

US 2015/0143605 A1 May 28, 2015

(51) Int. Cl.

| | |
|---|---|
| ***A41C 3/04*** | (2006.01) |
| ***A41D 1/22*** | (2006.01) |
| ***A41D 1/20*** | (2006.01) |

(52) U.S. Cl.

CPC ..... *A41D 1/205* (2013.01); *A41C 3/04* (2013.01); *A41D 1/22* (2013.01)

(58) Field of Classification Search

CPC ..... A41D 1/205; A41C 3/00; A41C 3/0064; A41C 3/04

USPC ..... 450/36, 30–33, 54–57; 2/104

See application file for complete search history.

(56) References Cited

U.S. PATENT DOCUMENTS

| | | | | |
|---|---|---|---|---|
| 6,645,041 | B2 * | 11/2003 | Sørensen | A41C 3/04 2/104 |
| 2004/0038621 | A1 * | 2/2004 | Vera | A41D 1/205 450/36 |
| 2007/0161330 | A1 * | 7/2007 | Whitehead | A41C 3/0064 450/36 |
| 2008/0000004 | A1 * | 1/2008 | Lucock | A41D 1/205 2/104 |
| 2008/0022434 | A1 * | 1/2008 | Adelman | A41D 1/205 2/104 |
| 2009/0265830 | A1 * | 10/2009 | Hendrickson | A41D 1/205 2/104 |
| 2010/0068971 | A1 * | 3/2010 | Hendrickson | A41C 3/04 450/31 |
| 2010/0068972 | A1 * | 3/2010 | Hendrickson | A41C 3/04 450/36 |
| 2011/0314587 | A1 * | 12/2011 | Ritchie | A41C 3/04 2/104 |

* cited by examiner

*Primary Examiner* — Gloria Hale
(74) *Attorney, Agent, or Firm* — Elizabeth Yang

(57) ABSTRACT

A garment for pumping milk includes an outer layer; an inner layer coupled to the outer layer at one end, the inner layer having a second end that is elastic, the inner layer having first and second pockets each allowing access to a breast and each having an elastic gathering to receive the breast pump shield.

18 Claims, 13 Drawing Sheets

HANDS-FREE PUMPING GARMENT

BACKGROUND

The present invention relates to a hands-free pumping garment.

Due to significant advantages of mother's milk over manufactured formula as a food source for infants, the American Academy of Pediatrics recommends that women breastfeed their infants for at least one year. While many women are able to nurse their infants directly from their breast, there are work related or mobility related reasons a woman may need or choose to pump milk for her child. For example, most women re-enter the workforce soon after childbirth and want to continue breastfeeding. Other women would like to pump their milk to give to the infant when they are uncomfortable or unable to directly nurse their babies. Breast pumps are used to extract the mother's milk when the child is not present.

Typically, breast pumps (manual and electric) use a conical pump funnel that is in direct contact with the breast to pump milk from the breast. The funnels must be held in place over the breast during the pumping process, otherwise they fall off when suction is lost. During this time, it is advantageous for the breastfeeding woman to have garments that facilitate breastfeeding, and breast pumping when a woman cannot nurse her infant.

Several brassieres and other garments have been developed that hold the funnel to the breast so that the mother does not need to hold the funnels while pumping (see U.S. Pat. Nos. 7,094,217, and 6,227,936).

U.S. Pat. No. 8,307,463 teaches a bra or tank that has three layers on the chest that allow the wearer to comfortably breast feed or pump milk hands-free. Specifically, the tank or bra has three detachable layers over the breast where the outer layer is a solid layer, the inner layer has two openings over the nipple that are equipped to receive the funnels of a breast pumping apparatus and hold them to the breast without the wearer holding them, and an inner layer that has a large opening for the breast so that the wearer may breast feed an infant.

SUMMARY

A garment for pumping milk includes an outer layer; an inner layer coupled to the outer layer at one end, the inner layer having a second end that is elastic, the inner layer having first and second pockets each allowing access to a breast and each having an elastic gathering to receive the breast pump shield.

Implementations of the garment can include one or more of the following. The pocket allows hands-free pumping. The 2-in-1 top allows for pumping and casual or professional wear after pumping. The inner layer containing pumping bra top, and the outer layer contains material overlay. The layers are non-detachable. The garment can include adjustable straps. Linear/Vertical openings are provided to support breast pumping apparatus. A double-layered elastic gathering that lines the linear/vertical openings can be used to increase support when using the breast pumping apparatus. Flexible, elastic band, for comfort purposes, that joins the top portion of the top to the bottom. The garment allows private or public pumping options to the mother. The garment is supportive, comfortable to wear. Short or long-sleeved options are available, as are casual or professional style options.

Advantages of the garment may include one or more of the following. By utilizing the garment, a mother may accomplish many tasks with her hands which would not be otherwise possible if the mother had to hold the breast pump to her breast and thus an entirely portable and hands-free breast pumping system is provided. The garment effectively holds the pump funnels in place in a comfortable manner that is practical for daily wear. The garment allows the wearer to pump hands-free, and the garment allows for hands-free pumping and pumping that is comfortable and practical for daily wear. The garment is designed to handle movement and motion. So when the mother gets moving, the garment will provide maximum support and holds the breasts firmly for the breast pump, making breast pumping more comfortable for mothers on the move. The garment fits snugly around the upper torso, holds the breasts in place, and to a significant extent, prevents the breasts from bouncing during motion with the breast pump.

Other advantages may include one or more of the following. The garment can be a bra or a tank that a woman can wear throughout the day that allows for hands-free pumping, while providing comfort and discretion. The garment is lightweight and breathable for long-lasting comfort. And its feminine scoop neck is perfect for Yoga, Pilates, and other low-impact workouts—the mother can even layer it under her favorite T-shirt for a seamless fit on her days off.

BRIEF DESCRIPTION OF THE DRAWINGS

FIG. 3A shows a back view of the breast pumping garment while

FIGS. 1A-1B shows exemplary side views of a breast pumping garment 200. This embodiment of the garment is a combined bra top (meaning that it has two layers) that consists of a "bra" portion and an outer layer, "top," that goes over that bra portion. FIGS. 1A-1B show the garment 200 rolled up to reveal the function and relationship of an inner layer with a breast pump. The outer layer can be a conventional dress for work or social events.

FIG. 1A shows the view of the outside of the garment 200 with a breast pump 114 with a breast shield embedded inside the garment 200. The garment 200 is worn over a female chest 100 with a shoulder strap 102. The garment 200 has an inner layer 106. A double-layered lining material 108 is used in one embodiment of the invention. The double-layered lining material 108 is part of the inner layer of the bra top, comprising the opening 110 (FIG. 1B) through which a breast pump 114 is attached thereto.

The garment 200 provides a layer of material that contains two slits (one for each breast) in which one layer overlay the other whose opening serves the purpose of holding breast shields or breast receptor cups in place (these surround the breast when the mother is pumping). In addition, lining the openings is elastic which has been gathered in order to provide a more snug fit for the shields. Additionally the "top" layer of material that is combined to fit over the bra portion allows the mother to wear conventional clothing so that she can go about work or daily activities. The "top" layer that overlays the bra portion of the top is a single layer of material with adjustable straps to offer more support, if necessary for pumping mothers, but most importantly, it allows for discrete pumping if the mother is in a public setting as it can partially cover the breasts if more privacy is warranted, and it also allows for the mother to return back to or maintain her current activity without the need to put on a top, shirt, and/or jacket before doing so. For example, with my invention, a mother can not only multitask while expressing/pumping breastmilk, but unlike the other products on the market which are only in hands-free bra forms, a mother can just cover the bra portion with the top layer of material and go. In other words, a bra cannot be worn by itself in public whereas my pumping bra top can be worn by itself, transformed for the mother to pump, and returned back to its natural state (all in one product).

Figure 1A:
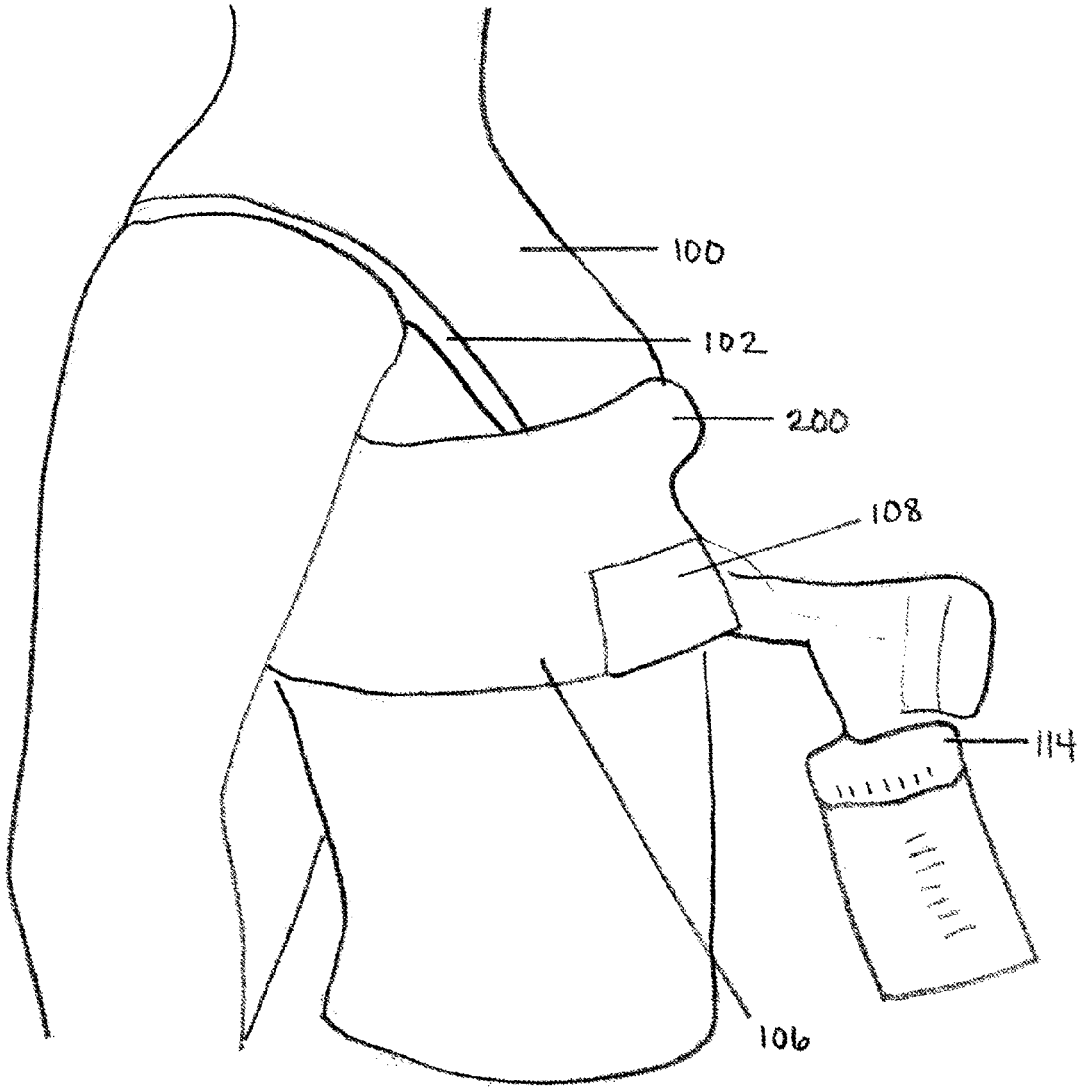
FIGS. 1A-1B shows exemplary side view of a breast pumping garment.
Figure 1B:
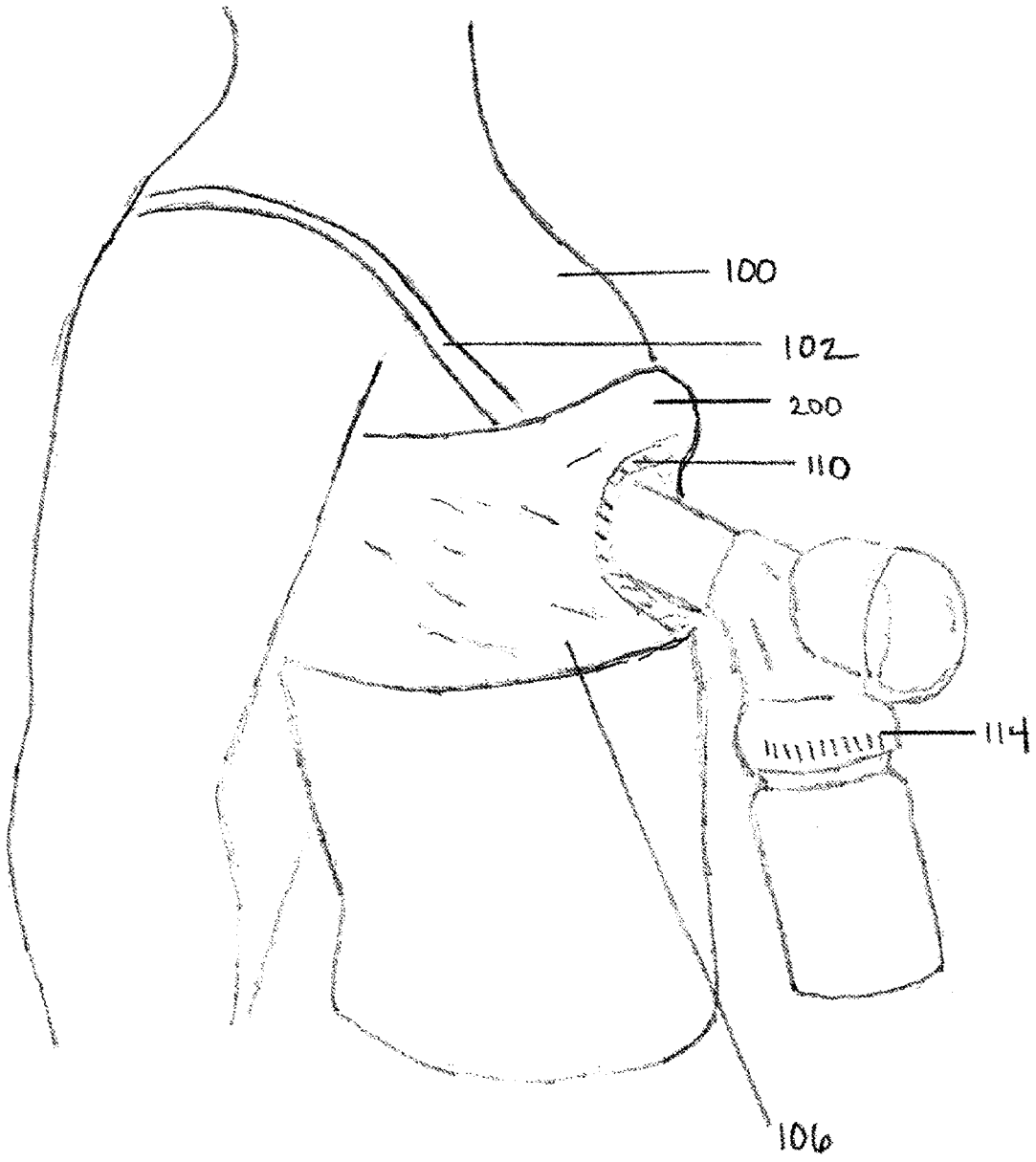

FIG. 1B shows the garment 200 worn over the female chest 100 and secured by the shoulder strap 102. The inner layer 106 has a double-layered elastic gathering/coverstitch 110, for support purposes, creating linear/vertical opening through which the pumping apparatus fits. The outer layer 200 is rolled up to reveal the function and relationship of the inner layer with the breast pump 114.

The garment includes an opening defined therein for positioning a breast receptor/shield through the opening. The breast receptor has an end for connection with a milk collection tube extending out from the opening in a direction away from the breast. The breast receptor support bra may further include an adjustment strap that has a plurality of position holders attached to the breast support cup. The garment holders secure the breast receptor in selected positions in the breast support cup.

The garment 200 has two breast receptor support openings 110 that support two breast support cups. A second milk collection tube may be connected to the second breast receptor for drawing breast milk into the container via the second collection tube. Thus, each breast receptor/shield is separately contained in an individual breast support opening 110.

The process of extracting milk from a mother's breast using the garment 200 and the breast pump 114 is as follows. The mother wears the bra top on her chest, and the insert the breast pump shield or breast receptor cup through the openings 110 over the breast. The breast pump is secured by the elastic bands in the opening 110. The mother then turns on the breast pump 114. When the suction pump of the breast pump 114 is turned on, a vacuum is created in the vacuum tube and up to the vacuum compartment. The vacuum created at the vacuum compartment causes a vacuum or suction action through the breast receptor cup or breast shield when breast receptor cup/shield is in connection with a breast. Upon the beginning of the suction at the breast, breast milk begins to flow through the vacuum compartment and down through a collection tube to a collection container which may be enclosed in some form of refrigeration pack or ice pack to keep the breast milk refrigerated. When a mother has determined that enough breast milk has been collected, the mother may turn off the breast pump 114 and remove the collection tube from the collection container for storing the collection container for later use.

The breast pump 114 may be a low vacuum suction pump operated by batteries or may be used with an AC adapter. A breast pump that 114 that may be used with the garment 200 is a small pump may be comfortably supported by or carried in the waist belt which may be a back support belt such as available from orthopedic supply firms, for example, Best Orthopedic Products, Inc. of Hickory, N.C. The breast pump may comprise a normal vibration pressure/vacuum, an adjustable suction regulator, an adjustable cycle valve and a battery pack. Vacuum pressure should be adjustable and operate within a range from zero to 280 mm Hg. Adjustments to the vacuum suction of the pump can be made by adjusting the appropriate control on the vacuum or the vacuum line as known by those skilled in the art. The breast pump 12 may be operated on an intermittent basis simulating the suction of a newborn infant. The suction cycle may also be varied by adjustment of a control on the breast pump 114. The suction cycle is preferably from 0.5 seconds to 120 seconds. The breast pump 114 may also include a timer that cycles on and off at selected intervals. For example, the timer may cycle on or off every two to three hours.

The garment 200 is sufficiently strong to support the breast pump 114. For larger pumps, a retaining strap such as a body strap can be used for securing the pump 114 on the body. The body strap may portably hold the collection container or the suction pump on the body. Preferably, the body strap is a waist belt with pockets.

Figure 2A:
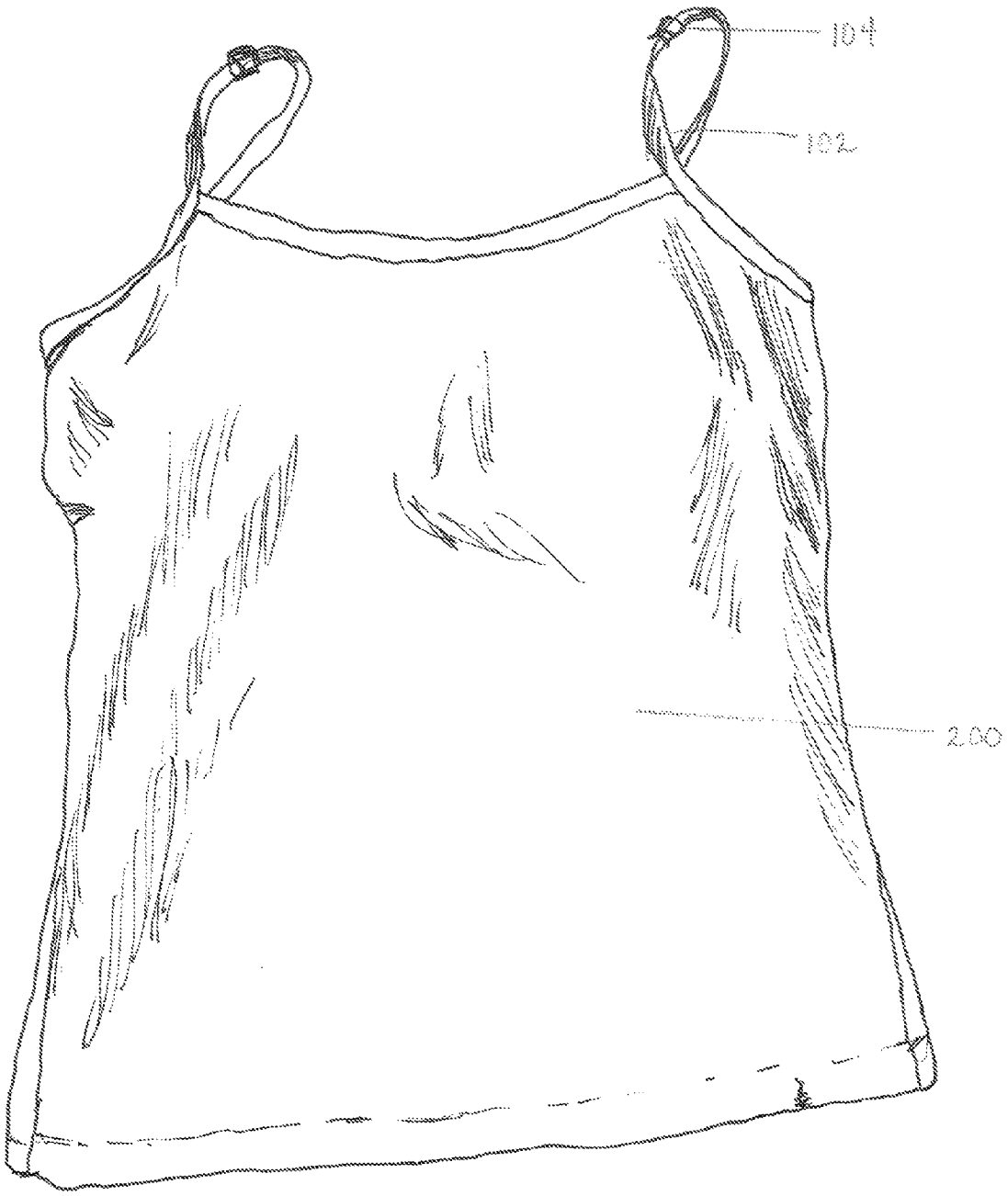
FIG. 2A shows an exemplary front view of a dress enclosing the garment of FIGS. 1A-1B.
Figure 2B:
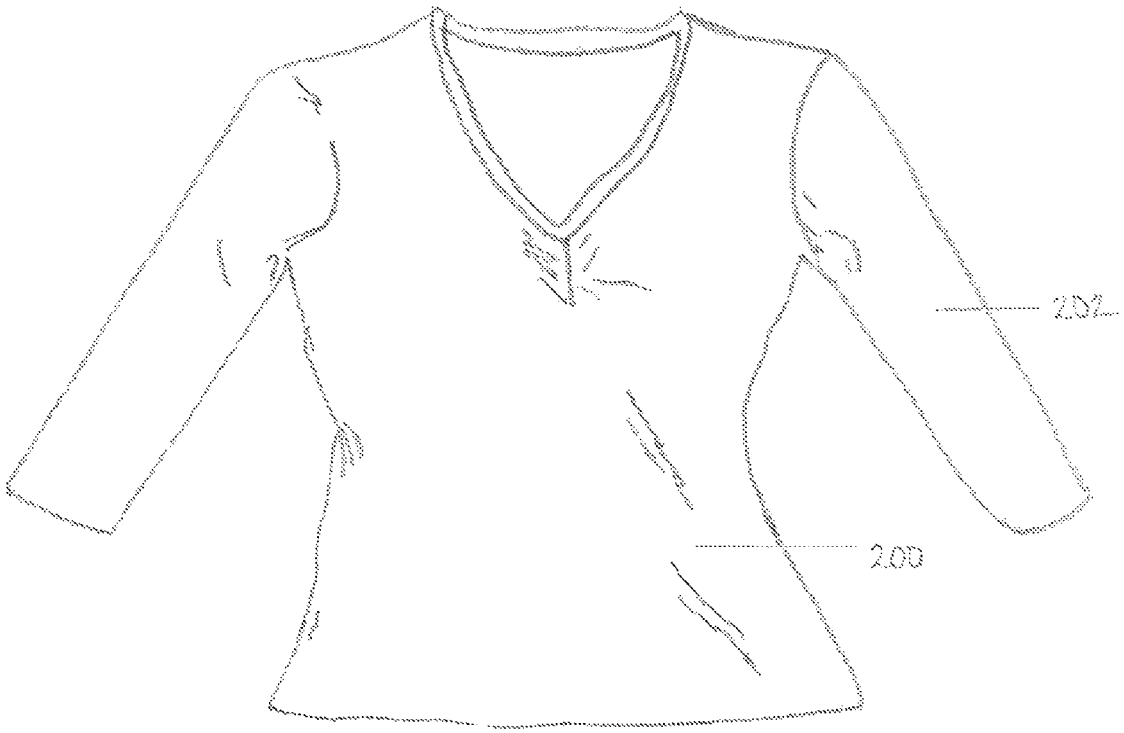
FIG. 2B shows an exemplary front view of a long sleeve dress outside the garment of FIGS. 1A-1B.

FIG. 2A shows an exemplary front view of a dress enclosing the garment of FIGS. 1A-1B, while FIG. 2B shows an exemplary front view of a long sleeve dress outside the garment of FIGS. 1A-1B. FIG. 2A shows a front view of a short-sleeved dress such as a tank top with an outer layer 200. The dress has a shoulder strap 102 with clasps 104. The clasp makes the shoulder straps adjustable to the wearer's size. FIG. 2B shows the front view of a long-sleeved dress. The outer layer 200 in this embodiment has a long sleeve 202.

Figure 3A:
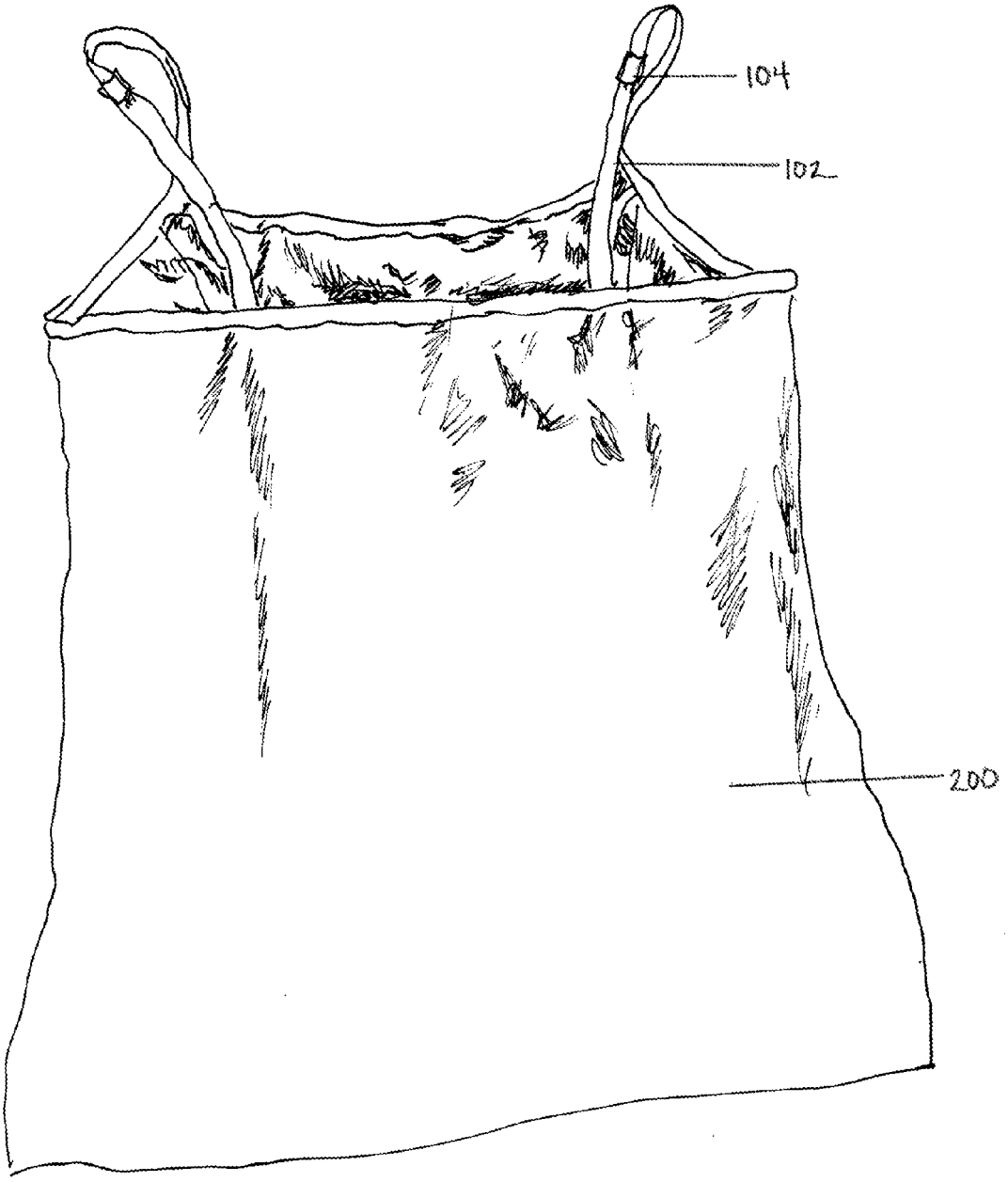
Figure 3B:
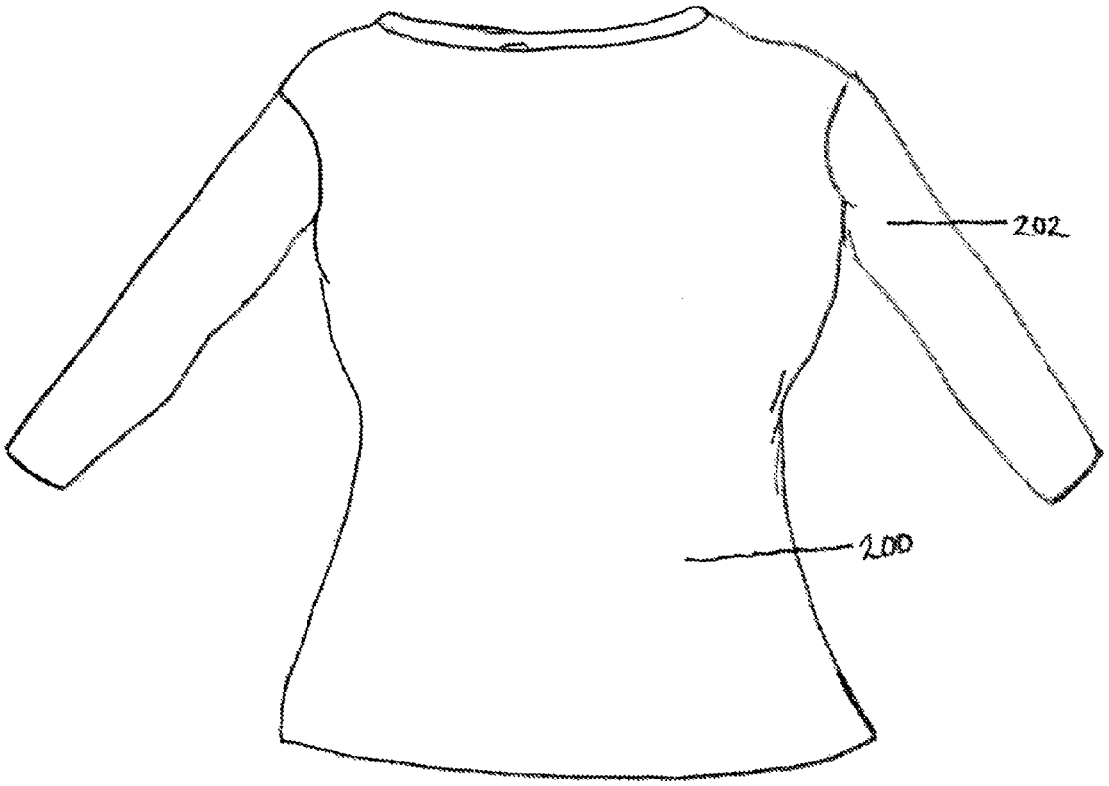
FIG. 3B shows a back view of the long-sleeved garment embodiment.

FIG. 3A shows a back view of a short-sleeved embodiment of the garment 200. The garment includes shoulder strap 102 secured by clasp 104 which makes the shoulder straps adjustable. FIG. 3B shows a back view of the long-sleeved garment embodiment including the outer layer 200 and the long sleeve 202.

Figure 4:
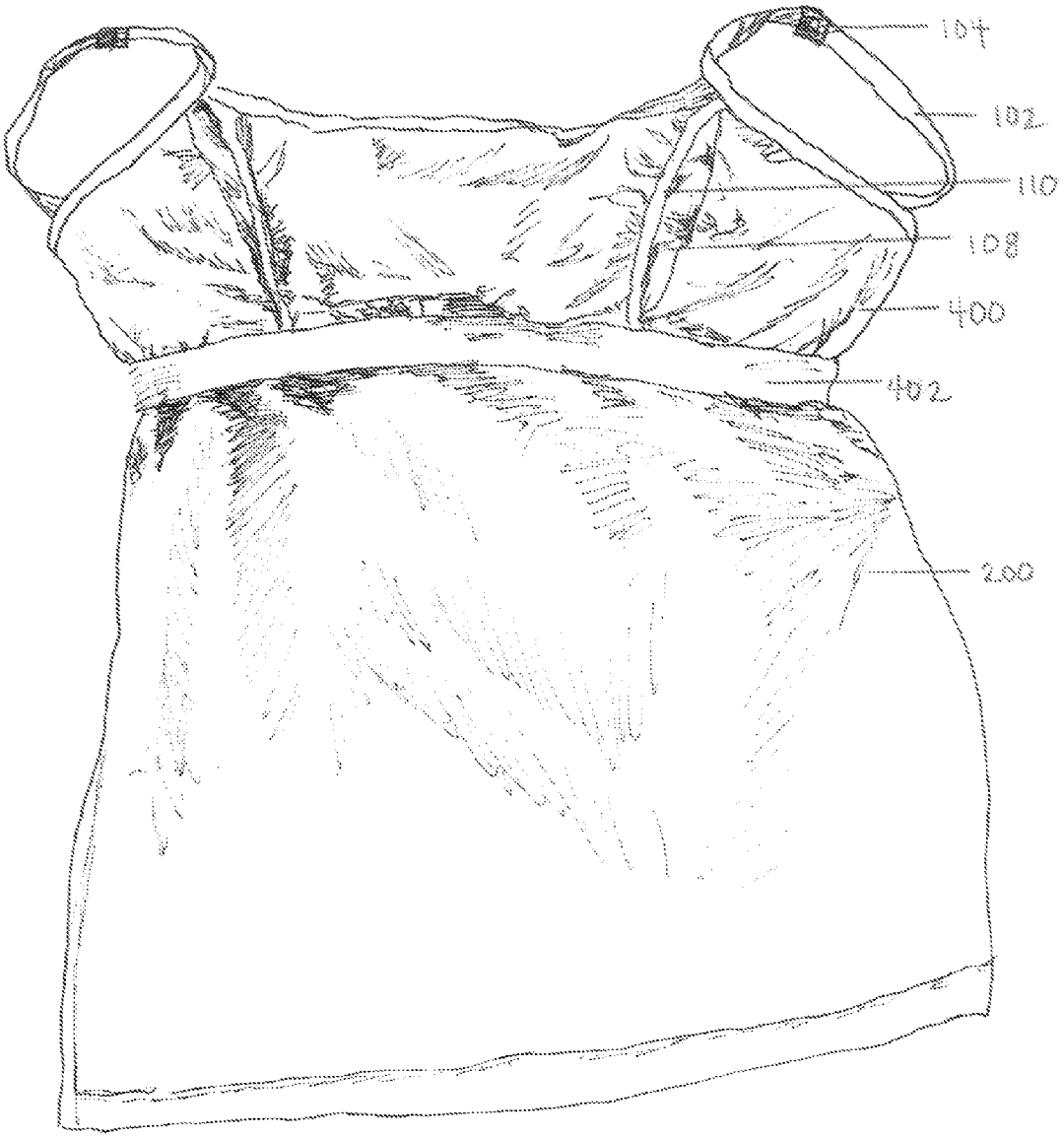
FIG. 4 shows an exemplary front view of the inside of the garment.

FIG. 4 shows an exemplary front view of the inside of the garment 200. The garment includes the shoulder strap 102 and clasp 104 which makes the shoulder straps adjustable. The double-layered lining material 108, which is part of the inner layer of the bra top in one embodiment, includes the linear openings through which the pumping apparatus fits. The double-layered elastic gathering/cover stitch 110, for support purposes, creates linear vertical or horizontal openings through which the breast pump fits. In this embodiment, the outer layer 200 is connected to an inner layer 400 with an elastic band 402 that connects the top layer of the pumping bra top to the bottom layer. In contrast, other embodiments simply stich or sew the inner and outer layers together. The elastic band 402 provides flexibility and comfort to the wearer.

Figure 5:
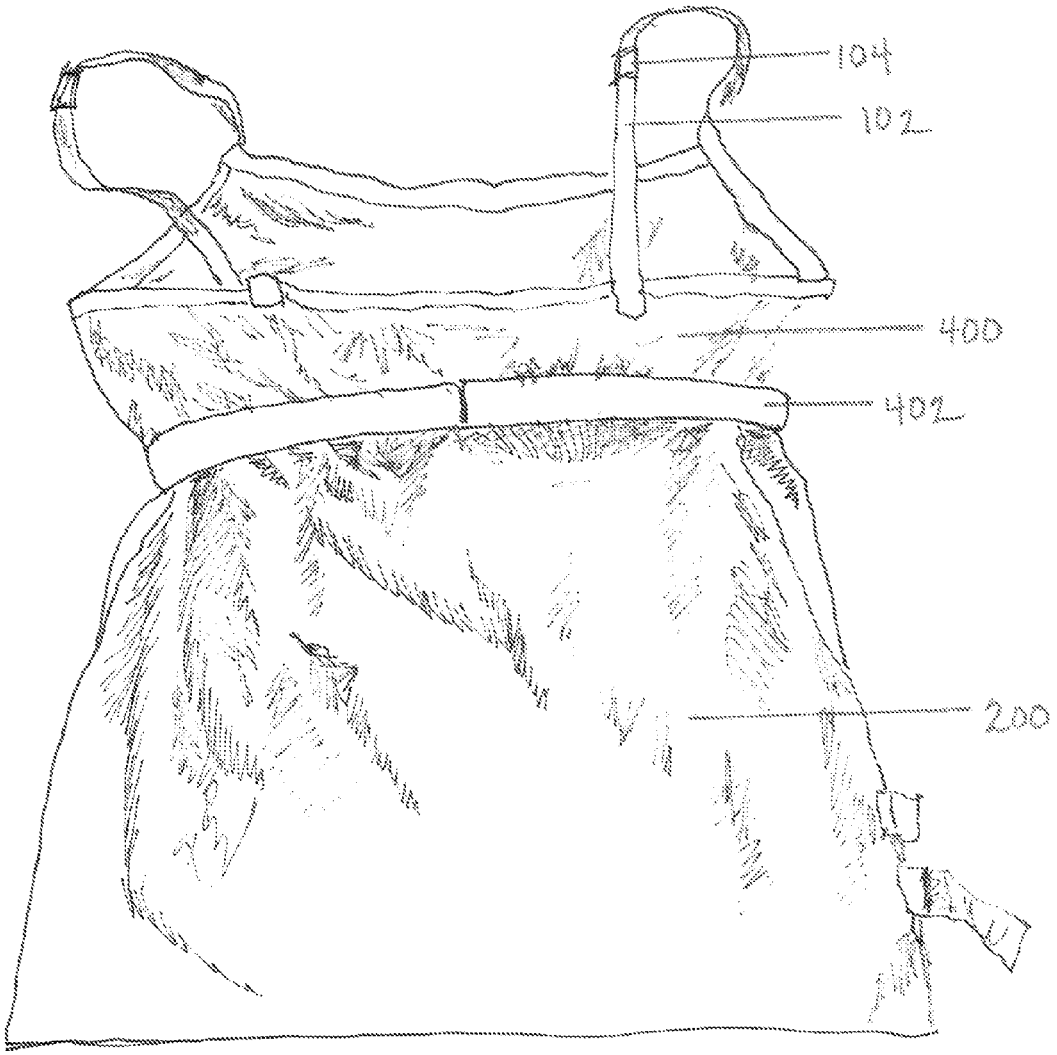
FIG. 5 shows an exemplary back view of the inside of the garment.

FIG. 5 shows an exemplary back view of the inside of the garment. The garment includes the shoulder strap 102 with clasp 104 which makes the shoulder straps adjustable. The outer layer 200 is connected to the inner layer 400 with the elastic band 402 that connects the top layer of the pumping bra top to the bottom layer.

Figure 6:
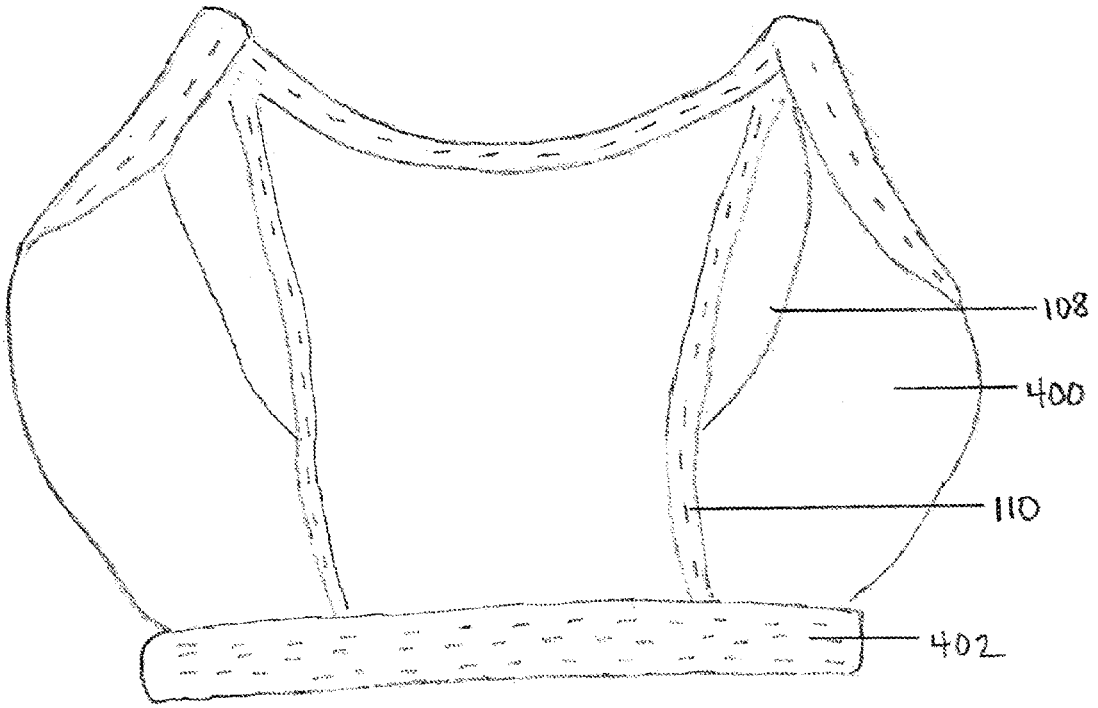
FIG. 6 shows an exemplary inner bra top portion.

FIG. 6 shows in more detail the inner bra top embodiment. The inner bra top has double-layered lining material 108 which is part of the inner layer of the bra top, comprising the linear openings through which the pumping apparatus fits. The double-layered elastic gathering/cover stitch 110 provides a slit which can provide linear/vertical/horizontal opening through which the pumping apparatus fits for support purposes. In this embodiment, an inner layer 400 fabric covers and supports the breast and is secured to the elastic band 402 that connects the top layer of the pumping bra top to the bottom layer.

Figure 7:
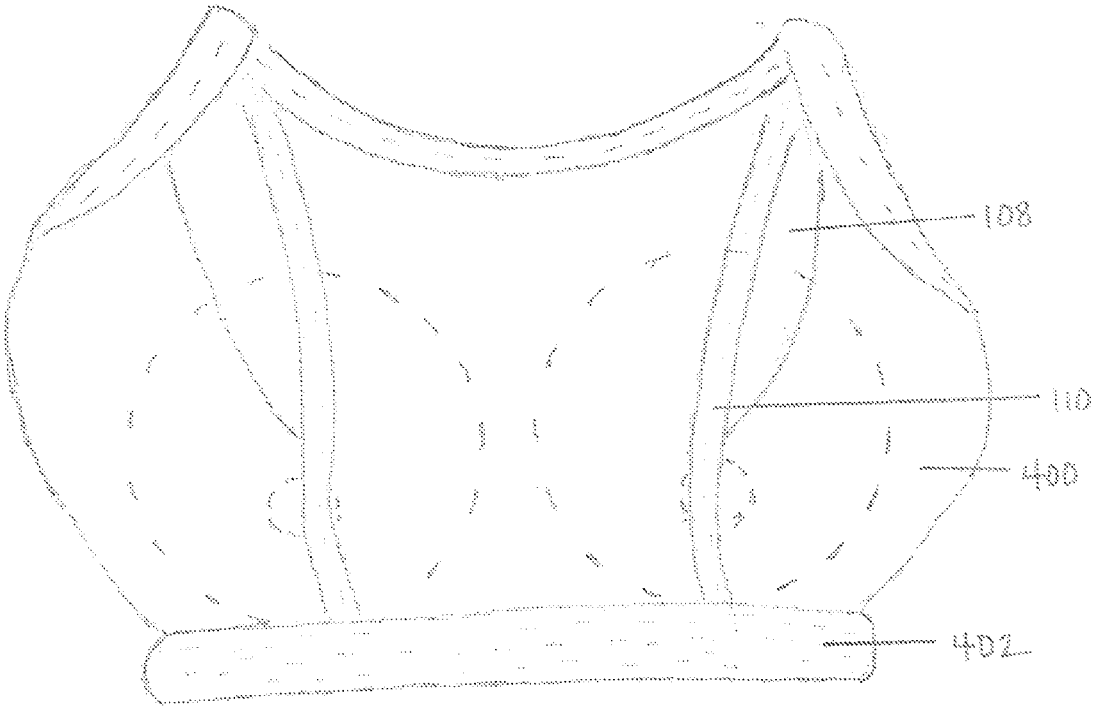
FIGS. 7-9 show exemplary views of various breast pumping garments.

FIG. 7 shows the inner bra top with a breast. As shown therein, the double-layered lining material 108, as one embodiment of the invention, which is part of the inner layer of the bra top, comprising the linear openings through which the pumping apparatus fits. The double-layered elastic gathering/cover stitch 110 provides linear/vertical opening through which the pumping apparatus fits. The inner layer 400 is connected to the elastic band 402 that connects the top layer of the pumping bra top to the bottom layer.

Figure 8:
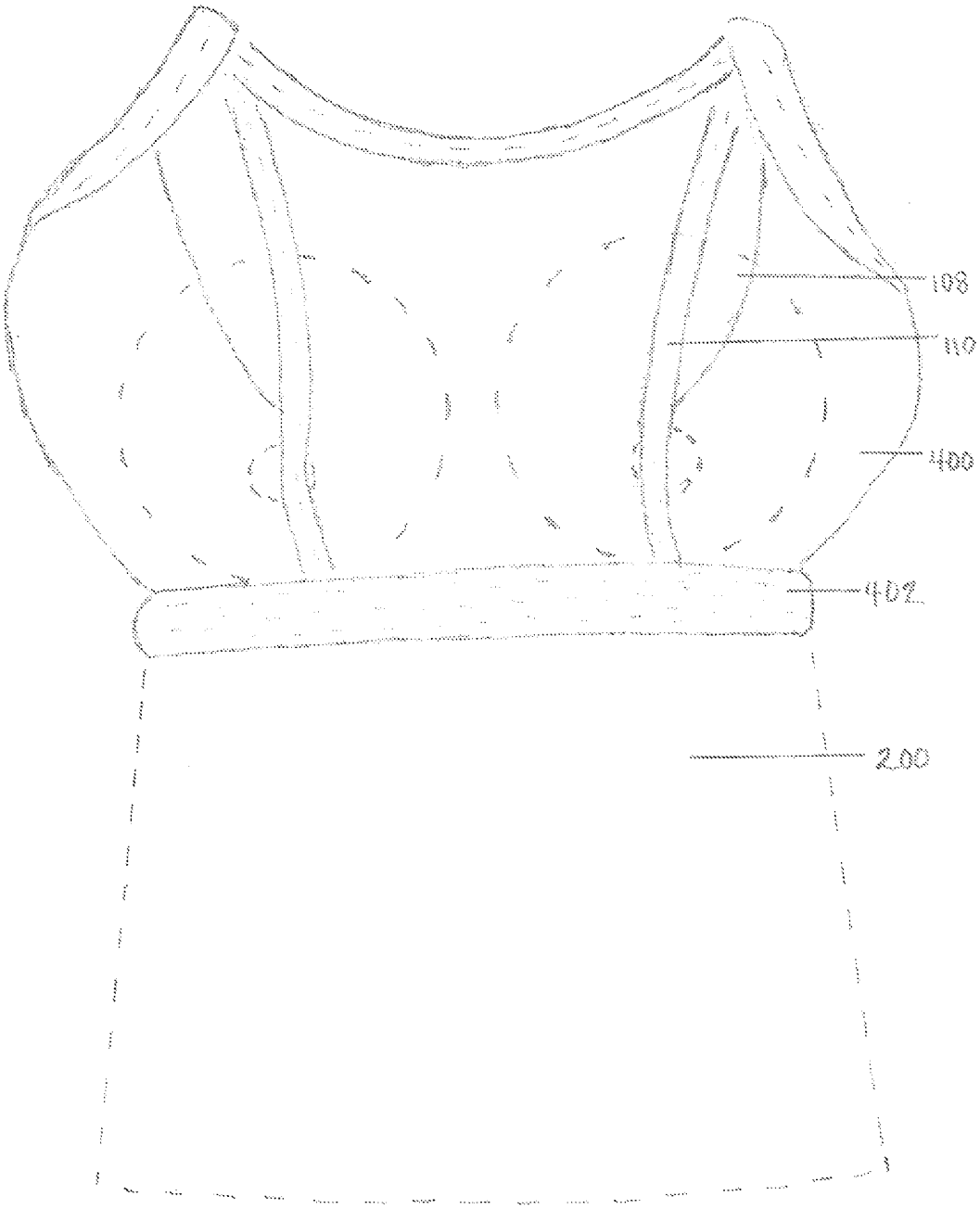

FIG. 8 shows another embodiment of the garment 200. The embodiment has double-layered lining material 108 which is part of the inner layer of the bra top, comprising the linear openings through which the pumping apparatus fits. The double-layered elastic gathering/cover stitch 110, for support purposes, provides linear/vertical opening through which the pumping apparatus fits. The outer layer 200 is connected to the inner layer 400 with the elastic band 402 that connects the top layer of the pumping bra top to the bottom layer.

Figure 9:
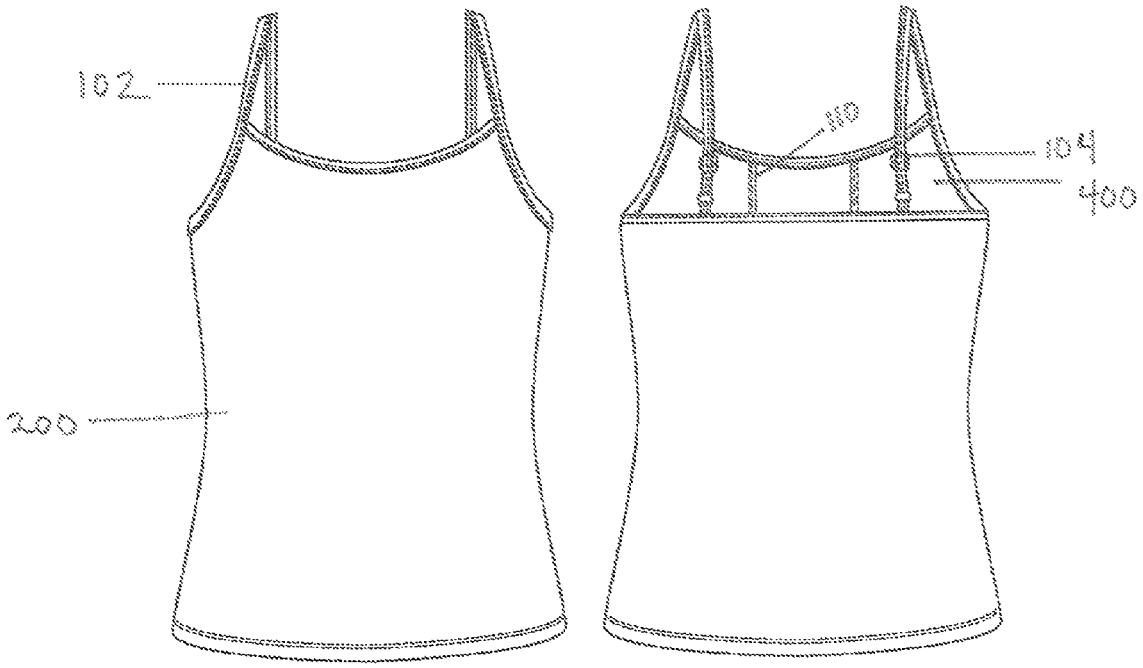

FIG. 9 shows yet another view of the garment 200. The shoulder strap 102 has clasp 104 which makes the shoulder straps adjustable. The double-layered elastic gathering/cover stitch 110, for support purposes, provides linear/vertical opening through which the pumping apparatus fits. The outer layer 200 is connected to the inner layer 400 by sewing or elastic band or other suitable securing mechanisms such as Velcro, for example.

Figure 10:
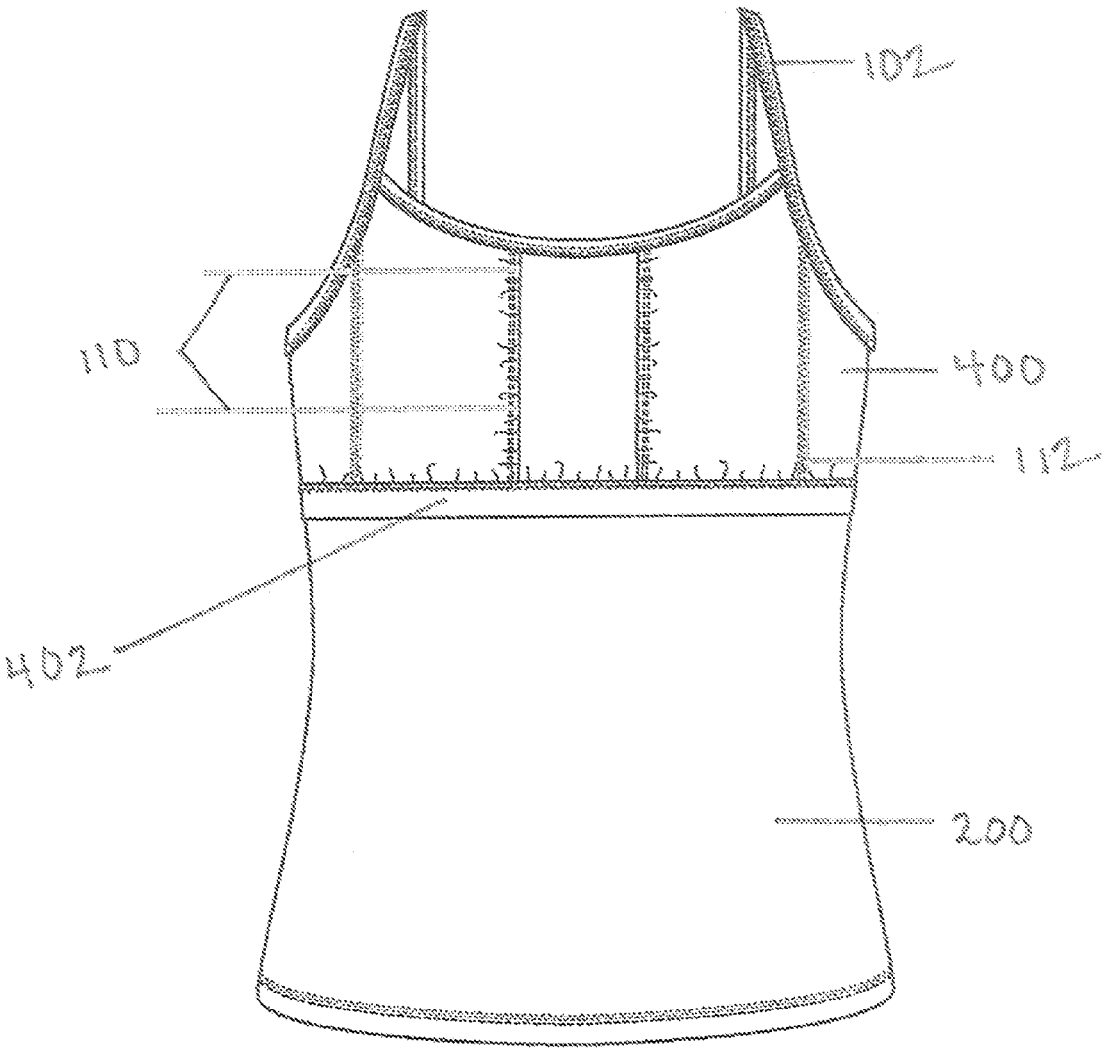
FIG. 10 shows another embodiment of an exemplary breast pumping garment.

FIG. 10 shows another embodiment of a bra-top garment. The shoulder strap 102 is connected to the garment 200. The double-layered elastic gathering/cover stitch 110, for support purposes, provides linear/vertical opening through which the pumping apparatus fits. The cover stich is done by folding edges over and ¼ inch elastic can be sewn with the edges. The outer layer 400 is connected to the inner layer 200 with an elastic band 402 that connects the top layer of the pumping bra top to the bottom layer. The garment has additional edge openings 112 for center panel fold and the cover stich is also done by folding edges over and ¼ inch elastic can be sewn with the edges. The folding is done so the seam allowance does not touch the skin. In this embodiment, the cover stich is an elastic that is approximately ¾ inch wide to 1 inch wide. The elastic is about 24.5 inch with a ¼ inch seam allowance. The front section is about 13 inches, and the back section is about 11 inches.

By utilizing the above garment, a mother may accomplish many tasks with her hands which would not be otherwise possible if the mother had to hold the breast pump to her breast and thus an entirely portable and hands-free breast pumping system is provided.

The present invention is particularly useful to a mother who is unable to nurse her child due to reasons such as recovery from a "Cesarean" section, the child being born prematurely, illnesses which necessitate a need for intensive care and intravenous feedings, or when the mother is working and the infant is in daycare. Using the garment to securely hold the breast pump in place during the pumping process allows a mother to use the system overnight. By using this system overnight, the mother will be able to attach the breast pump before sleeping which allow the pump to work during the night. The pump may slowly extract or pump every ten to 120 seconds and may collect milk in a refrigerated unit or refrigerated ice chest. During the day, the present invention allows the mother to collect breast milk virtually unencumbered by the breast pump system of the present invention.

The description contained herein is for purposes of illustration and not for purposes of limitation. Changes and modifications may be made to the embodiments of the description and still be within the scope of the invention. Furthermore, obvious changes, modifications or variations will occur to those skilled in the art. Also, all references cited above are incorporated herein by reference, in their entirety, for background and to assist the reader of this disclosure.

While the invention has been shown and described herein with reference to particular embodiments, it is to be understood that the various additions, substitutions, or modifications of form, structure, arrangement, proportions, materials, and components and otherwise, used in the practice and which are particularly adapted to specific environments and operative requirements, may be made to the described embodiments without departing from the spirit and scope of the present invention. Accordingly, it should be understood that the embodiments disclosed herein are merely illustrative of the principles of the invention. Various other modifications may be made by those skilled in the art which will embody the principles of the invention and fall within the spirit and the scope thereof.

The invention claimed is:

1. A garment, comprising:

an outer layer; and an inner layer coupled to the outer layer through an elastic band, the inner layer comprising a double layered elastic gathering configured to form a first pocket and a second pocket, the double layered elastic gathering disposed along an edge of panels that form the first pocket and the second pocket, wherein the double layered elastic gathering is configured to enable holding a breast pump to enable hands free pumping, each pocket allowing access to a breast through at least one opening, wherein the elongated double layered elastic gathering has at least a first connection to the outer layer, an inner layer and a second connection to the inner layer.

2. The garment of claim 1, comprising a breast pump shield inserted into one pocket and secured by the elastic gathering.

3. The garment of claim 1, wherein the garment is a brassiere, tank, tank top, or bra top.

4. The garment of claim 1, wherein the garment is a tank comprising a breast receptor support with an adjustment strap that has a plurality of position holders attached to a breast support cup to secure the breast pump in selected positions in the breast support cup, further comprising edge openings for a center panel fold and a cover stitch formed by folding edges over and ¼ inch elastic is sewn with the edge openings and wherein a seam allowance does not touch the skin, wherein the cover stitch is an elastic thread having a front section of about 13 inches, and a back section of about 11 inches.

5. The garment of claim 1, comprising an adjustable strap to secure the garment on a shoulder.

6. The garment of claim 1, comprising an elastic band coupling the outer layer to the inner layer.

7. The garment of claim 1, comprising a seam to attach the outer layer to the inner layer.

8. The garment of claim 1, wherein the at least one opening over each nipple of the wearer is vertical.

9. The garment of claim 1, wherein the layers comprise a 2-in-1 top that allows for pumping and casual or professional wear after pumping.

10. The garment of claim 1, wherein the inner layer contains a pumping bra top and the outer layer contains a material overlay.

11. The garment of claim 1, wherein layers are non-detachable.

12. The garment of claim 1, wherein the pocket comprises an opening to support a breast pump.

13. The garment of claim 1, wherein the pocket comprises double-layered elastic gathering that lines an opening to increase support when using a breast pump.

14. The garment of claim 1, comprising a flexible, elastic band joining a top portion of the outer layer to the bottom of the inner layer.

15. A method for performing private or public milk extraction, comprising:

wearing a garment over a chest, the garment including an outer layer, and an inner layer coupled to the outer layer at one end, the inner layer comprising a double layered elastic gathering configured to form a first pocket and a second pocket, the double layered elastic gathering disposed along an edge of panels that form the first pocket and the second pocket, wherein the double layered elastic gathering holds a breast pump to enable hands free pumping, each pocket allowing access to a breast through an opening;

inserting a breast pump shield through one pocket; and performing hands-free milk extraction using the breast pump shield.

16. The method of claim 15, comprising using a breast receptor support with an adjustment strap that has a plurality of position holders attached to a breast support cup to secure the breast pump in selected positions in the breast support cup, further comprising edge openings for a center panel fold and a cover stitch formed by folding edges over and ¼ inch elastic is sewn with the edges and wherein a seam allowance does not touch the skin, wherein the cover stitch is an elastic that is approximately ¾ inch wide to 1 inch wide, about 24.5 inch with about a ¼ inch seam allowance with a front section of about 13 inches, and a back section of about 11 inches.

17. The method of claim 15, comprising joining a top portion of the outer layer to a bottom of the inner layer with a flexible, elastic band.

18. The method of claim 15, wherein the outer layer attaches to the inner layer through an elastic band.

* * * * *